US005947782A

United States Patent [19]

Siladke et al.

[11] Patent Number: 5,947,782

[45] Date of Patent: Sep. 7, 1999

[54] MOTORIZED TUBULAR FLOTATION APPARATUS

[76] Inventors: E. Robert Siladke, 35345 Lana La., Sterling Heights, Mich. 48312; Albert W. Evenson, 33815 Lighthouse Point, New Baltimore, Mich. 48047

[21] Appl. No.: 08/968,410

[22] Filed: Nov. 12, 1997

[51] Int. Cl.[6] ..... B63C 9/08

[52] U.S. Cl. ..... 441/129; 441/132; 440/6; 440/72

[58] Field of Search ..... 114/315; 441/35, 441/55, 80, 129, 130, 131, 132, 133; 440/6, 7, 72, 38, 66

[56] References Cited

U.S. PATENT DOCUMENTS

| | | | |
|---|---|---|---|
| 1,718,637 | 6/1929 | DePento . | |
| 3,007,432 | 11/1961 | Still | 440/6 |
| 3,405,677 | 10/1968 | Smith . | |
| 3,685,480 | 8/1972 | Peroni | 440/6 |
| 4,700,654 | 10/1987 | Borges . | |
| 4,911,094 | 3/1990 | Akers . | |
| 4,938,722 | 7/1990 | Rizley . | |
| 4,996,938 | 3/1991 | Cameron et al. . | |
| 5,090,933 | 2/1992 | Walden . | |
| 5,158,034 | 10/1992 | Hsu . | |
| 5,372,527 | 12/1994 | Cardona . | |
| 5,403,220 | 4/1995 | Goad, Sr. . | |
| 5,568,783 | 10/1996 | Ditchfield . | |
| 5,571,036 | 11/1996 | Hannigan | 441/132 |
| 5,785,563 | 7/1998 | Peaslee | 440/6 |

*Primary Examiner*—Stephen Avila
*Attorney, Agent, or Firm*—Young & Basile, PC.

[57] ABSTRACT

A propulsion apparatus is mounted on at least one end of a flexible tubular flotation member which is mountable about the body of the user. The propulsion apparatus is capable of propelling the tubular member and the user in the water. In one embodiment, a housing containing a motor driven propeller is fixedly mountable over one end of the tubular member. A guard containing an open mesh surrounds the propeller. In another embodiment, the housing and the propulsion means are mounted in a bore in the end of the tubular member, with the propeller projecting outward from the end of the tubular member.

22 Claims, 3 Drawing Sheets

FIG-1
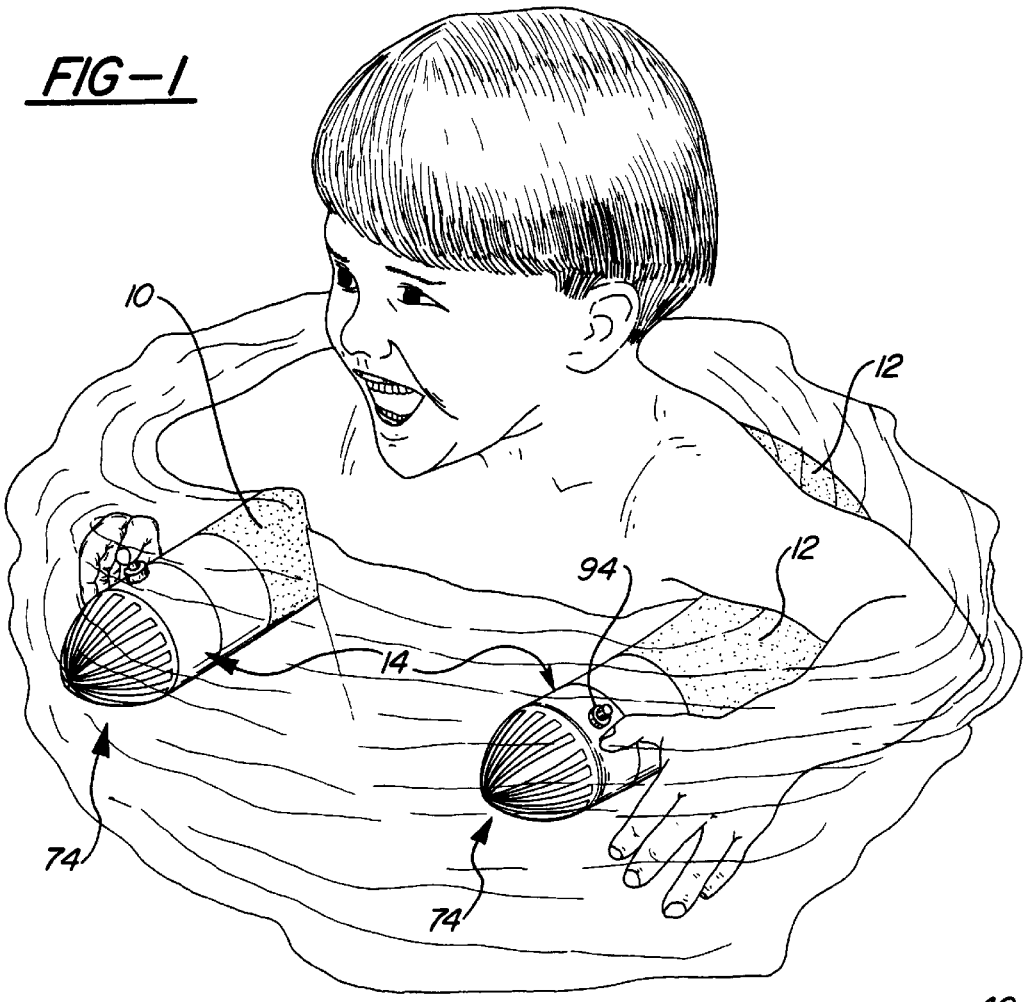
FIG-4
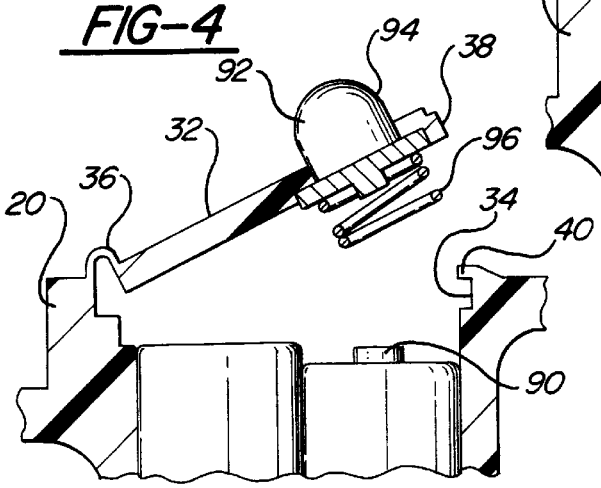
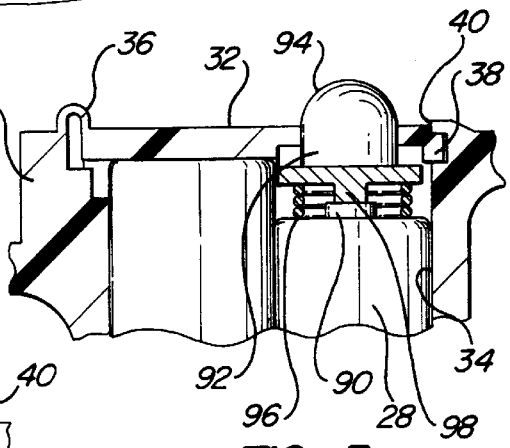
FIG-5

MOTORIZED TUBULAR FLOTATION APPARATUS

BACKGROUND OF THE INVENTION

FIELD OF THE INVENTION

The present invention relates, in general, to flotation devices and, more particularly, to motorized flotation devices.

A variety of aquatic devices have been created to support individuals on the water surface. Such devices include kickboards, swimming boards, tubes, air mattresses and even full sized chairs. Some devices have been provided with motor driven propellers to propel the user to the water.

A new aquatic flotation device which has become widely popular is a so-called "noodle". The noodle is an elongated three to four foot cylindrical member made of a closed cell foam. The noodle is capable of supporting the user on the water surface.

It would be desirable to provide a propulsion means to an elongated tubular flotation device or noodle to enable the flotation device and the user to be propelled across the water surface at the user's directional choice and/or speed. It would also be desirable to provide such a propulsion means which can be easily mounted on or attached to an existing elongated tubular flotation device or noodle.

SUMMARY OF THE INVENTION

The present invention is a propulsion apparatus for use with the elongated, flexible tubular flotation member having first and second ends which supports the body of a user on the waters surface.

In one embodiment, the apparatus includes propulsion means which is mountable to at least one of the first and second ends of the elongated tubular member for propelling the tubular member and the user through the water. Preferably, the propulsion means is mounted on both ends of the tubular member.

The propulsion means, in an exemplary embodiment, includes a housing containing an electric motor. A power source, such as batteries, for example, are mounted in the housing and connected via a user actuated means or switch to the motor to rotate a motor output shaft. A propeller is mounted on the output shaft.

A guard means is preferably mounted on the housing and surrounds the propeller to prevent user contact with the rotating propeller while still enabling adequate water flow about the propeller for an adequate propulsion force to be generated by the propeller.

Means are provided for mounting the propulsion means to at least one and preferably both of the first and second ends of the tubular member. In one embodiment, the mounting means includes a bore formed in the housing which fixedly receives one end of the tubular member therein. Retaining means, preferably in the form of one or more inward angularly extending fingers, are formed within the housing for fixedly engaging the tubular member. In another embodiment, the housing is fixedly mounted in a bore in one end of the tubular member, with the propeller extending outward from the end of the tubular member.

The user actuated means or switch mounted on the housing enables the user to selectively activate one of the motors of the propulsion means on one or both ends of the tubular member simultaneously with the other motor, alternately, or one at a time in any desired sequence. This enables the user to propel himself or herself through the water in any desired path of movement or in any direction.

The present invention uniquely provides a propulsion capability to an elongated tubular flotation device or noodle. The propulsion means is easily applied to or mounted on an existing elongated flotation device without requiring significant or any modifications to the flotation device. The present motorized tubular flotation apparatus increases the enjoyment of an existing elongated tubular flotation device or noodle.

BRIEF DESCRIPTION OF THE DRAWING

The various features, advantages and other uses of the present invention will become more apparent by referring to the following detailed description and drawing in which:

FIG. 1 is a pictorial illustration depicting one example of the use of the present motorized tubular flotation apparatus;

FIG. 4 is an enlarged, cross-sectional view depicting the battery compartment panel in an open position;

FIG. 5 is an enlarged, cross-sectional view depicting the battery compartment panel in a closed position and the actuator push button depressed for activation of the motorized tubular flotation apparatus.

DESCRIPTION OF THE PREFERRED EMBODIMENTS

Figure 2:
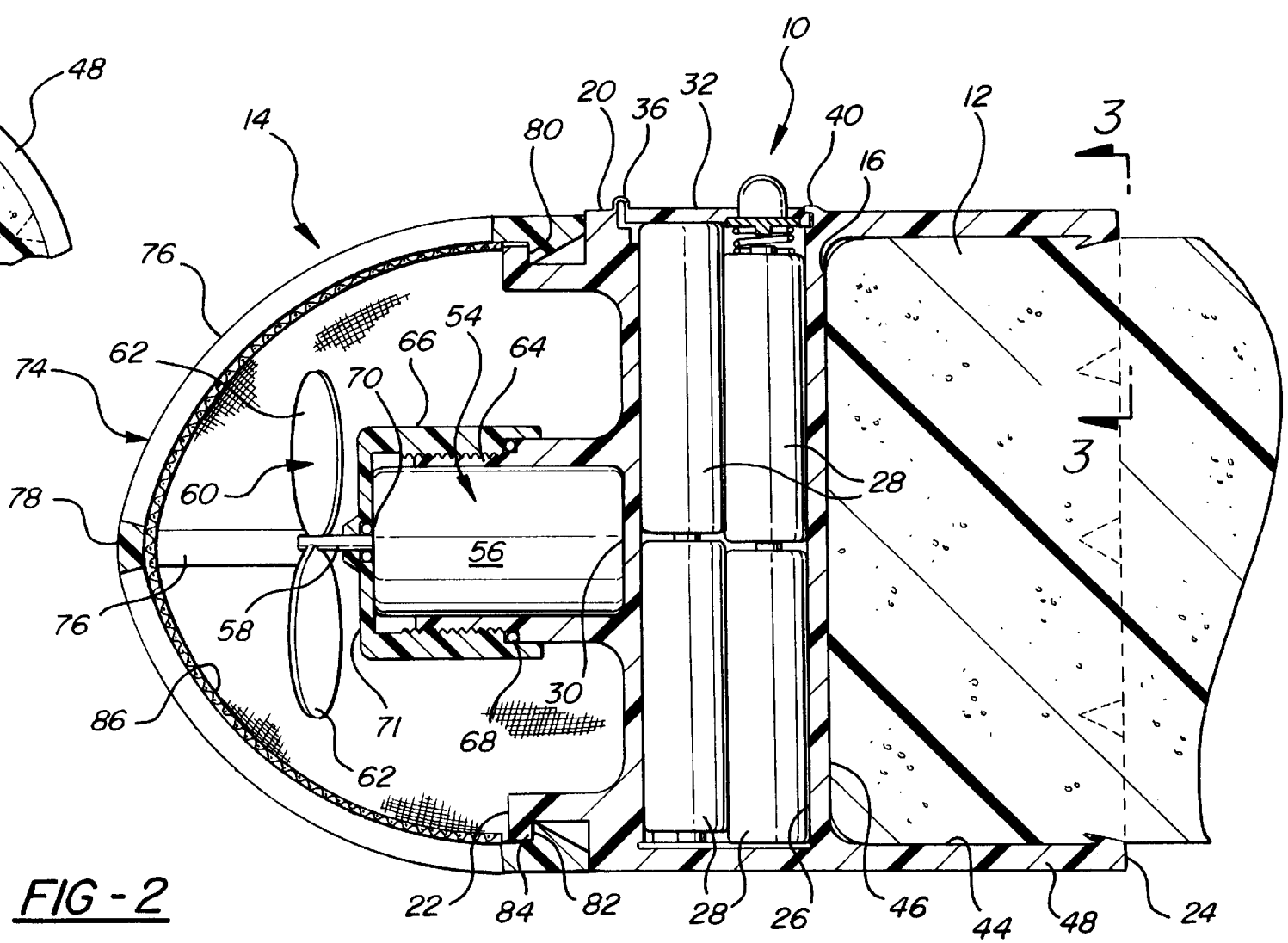
FIG. 2 is a longitudinal cross-sectional view through one end of the flotation apparatus shown in FIG. 1.

Refer now to the drawing, and to FIGS. 1–5 in particular, there is depicted a first embodiment of a motorized tubular flotation apparatus 10. The apparatus 10 is formed of an elongated tubular member 12 and at least one and preferably a pair of propulsion means or apparatus 14.

The elongated tubular member 12 may be provided in any length, with three or four foot lengths being preferred. The tubular member 12 is commonly known as a "noodle" and is formed of a closed cell foam to provide flotation or buoyant characteristics enabling a user, shown in FIG. 1, to be supported on the water surface by the tubular flotation member 12. The tubular member 12 has opposed first and second ends, with only first end 16 being shown in FIG. 2.

Although the tubular member 12 has a generally circular cross-section, it will be understood that the tubular member 12 may be formed in other cross-sectional shapes, such as polygonal, i.e., square, rectangular, triangular, hexagonal, octagonal, etc., as well as oval, elliptical, etc.

The propulsion apparatus 14 is applied to at least the first end 16 of the tubular member 12. For added versatility, a pair of propulsion apparatus 14 are individually mounted on each of the first and second ends of the tubular member 12. Each propulsion apparatus 14 is formed of a housing 20 which includes opposed first and second ends 22 and 24 and a sealable intermediate compartment 26.

The intermediate compartment 26 is sized to receive one or more batteries 28 which are used to provide electrical power to the propulsion means described hereafter. In a preferred embodiment, four AA batteries are serially mounted within the compartment 26 in two end-to-end pairs. Individual wires extend from the endmost contacts of the batteries 28 to the propulsion means via an aperture 30 formed in one side wall of the compartment 26.

Although the following description of the batteries 28 are described as being used as a power source for the motor 56, it will be understood that other suitable power sources, such as power cells, etc., may also be employed.

As shown in FIGS. 2, 4 and 5, a moveable panel 32 is disposed over an open end 34 of the compartment 26 and is adapted for singly closing the open end 34 of the compartment 26 after the batteries 28 have been inserted into the compartment 26. Although the panel 26 could be provided in separable engagement with the surrounding portions of the housing 20, in a preferred embodiment, the panel 32 is integrally formed with the housing 26 and is connected to the housing 20 by a living hinge 36. The panel 32 has an outer end 38 opposed from the living hinge 36 which is releasably engageable with a lip or flange 40 projecting from an opposite surface of the housing 20. The outer end 38 may be snapped beneath the lip 40 to position the panel 32 in a closed, sealing position over the open end 34 of the compartment 26. However, the panel 32 may be easily pivoted about the hinge 36 and disengaged from the outer end 38 from the lip 40 to enable the panel 32 to be pivoted to the open position shown in FIG. 4.

Figure 3:
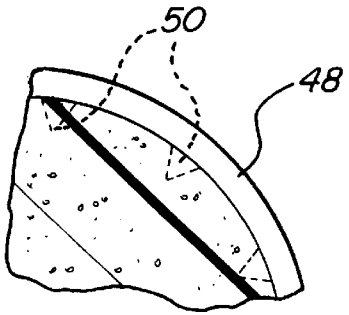
FIG. 3 is a cross-sectional view generally taken along line 3—3 in FIG. 2.

Referring now to FIGS. 2 and 3, a bore 44 projects inward from the second end 24 of the housing 20 and extends between the second end 24 to a sidewall 46 forming a portion of the intermediate compartment 26. Since the tubular member 12 has been described, in an exemplary embodiment, as having a circular cross-section, the sidewall 48 of the housing 20 extending between the second end 24 and the compartment sidewall 46 also have an annular shape and an inner diameter generally the same as the outer diameter tubular member 12. In this manner, the tubular member 12 may be inserted into the bore 44 extending inward from the second end 24 of the housing 12 in a snug fit.

Means are provided for securely retaining the first end 16 of the tubular member 12, in the bore 44 in the housing 20. The retaining means 50 is generally in the form of a plurality of fingers which are formed on an inner surface of the sidewall 48 of the housing 20 and project angularly inward at an acute angle with respect to the sidewall 48 away from the second end 24 of the housing 20 and toward the compartment sidewall 46. The tip or end of each finger 50 is pointed to dig into and securely engage the tubular member 12 to prevent easy separation of the first end 16 of the tubular member 12 from the bore 44 in the housing 20. However, due to the resilient nature of the tubular member 12, it is possible to forcibly remove the end of the tubular member 12 from the bore 44 in the housing 20. However, ripping of the outer surface of the end of the tubular member 12 by the fingers 50 will likely occur.

The propulsion apparatus 14 includes a propulsion means 54 generally in the form of an electric motor 56 having an output shaft 58. The motor 56 preferably rotates the output shaft 58 in one direction when electric power is supplied thereto, as described hereafter. However, it is possible with suitable circuit modifications and switch arrangements to utilize a motor 56 having a bi-directionally rotatable output shaft.

A propeller 60 is fixedly mounted on the output shaft 58 of the motor 56. The propeller 60 may be provided with any number of blades 62 which can be disposed at any pitch to generate propulsion force. The propeller 60 may be formed of suitable water immersible materials, with plastic being preferred due to its light weight and corrosion resistance.

The motor 56 is preferably a water immersible motor which provides low output torque to enable the propeller blades 62 to be easily stopped from rotation when contacted by a user's fingers.

The motor 56 may also be provided with suitable variable current input by a variable actuator to thereby provide varying speeds of rotation of the output shaft 58 and propeller 60.

The motor 56 is mounted in a tubular sleeve integrally formed as part of the housing 20 and projecting from one of the sidewalls forming the compartment 26. A cover 66 is mountable over the open end of the sleeve 64 after the motor has been inserted into the sleeve 64. Seal members, such as one or more O-rings 68, may be interposed in annular grooves on the outer surface of the sleeve 64 to sealingly engage the cover 66 with the sleeve 64.

An aperture formed in an end wall 71 of the cover 66 receives the motor output shaft 58 therethrough. Seal members or O-ring 70 are mounted between the motor output shaft 58 and the surrounding portions of the end wall 71 of the cover 66 to sealingly close the aperture in the cover 66.

According to a unique feature of the present invention, a guard means denoted in general by reference number 74 is mounted about the propeller 60 to prevent user contact with the propeller 60 while still enabling water to surround the propeller 60 for adequate propulsion. The guard 74 may take a variety of different forms. By way of example only, the guard 74 is formed with a pair of arcuately shaped ribs 76 which are disposed 90° from each other and intersect at an outer end 78. Opposed ends of each of the ribs 76 terminate in an annular ring having a tab 80 which is adapted to engage a notch 82 formed by a radially outward extending flange 84 on the first end 22 of the housing 20. The tab 80 snaps into the notch 82 to securely, but removable mount the guard 74 on the first end 22 of the housing 20.

Screen or mesh members 86 are integrally formed with and extend between the ribs 76. Openings between adjacent mesh members 86 are provided in a small size to prevent the introduction of the user's finger through the openings into contact with the rotating propeller 60; while still providing adequate water flow therethrough to enable sufficient propulsion to be generated by the propeller 60.

As shown in FIGS. 2, 4 and 5, the plurality, such as 4 AA batteries 28 are mounted in the compartment 26 generally perpendicular to the motor output shaft 58. The contact 90 on one end most battery 28 is positioned adjacent the open end 34 of the compartment 26 and the pivotal panel 32. An actuator 92, such as a push button, is movably housed within an enlarged or bulbous portion 94 of the panel 32. The enlarged portion 94 of the panel 32 has suitable resiliency to enable user force exerted on the enlarged portion 94 to move the actuator 92 disposed underneath from a first normal position established by the biasing force of an internally mounted spring 96 to a depressed position whereat a conductive pad 98 on the end of the actuator push button 92 engages the contact 90 on the battery 28 to complete a circuit through the serially connected batteries 28 and the motor 56 to supply electric power to the motor 56 for rotation of the output shaft 58 and the propeller 60.

In use, with the batteries 28 inserted in the correct serial arrangement within the compartment 26 and the panel 32 in its sealingly closed position, as shown in FIG. 2, the user may wrap the tubular member 12 about his or her body with the opposed ends of the tubular member 12 projecting forward of the user's torso, shown in FIG. 1, in a convenient position to enable the user's fingers to easily engage the enlarged portions 94 and the underlying actuators 92 on the housings 20. The user may thus depress the actuator or push button 92 on one or both of the housings 20 to thereby supply electric power to the motor 56 and cause immediate rotation of the attached propeller 60. This generates propulsion force to propel the user through the water surface. The user may energize the motors 56 on both ends of the tubular member 12 to propel the user backwards in a generally straight path. Alternately; the user may activate one of the motors 56 at a time to propel the user backwards in an arcuate path. By alternately and individually activating each of the motors 56, the user may propel himself/herself in a sinuous path through the water. Of course, it is clear that activating both of the motors 56 at the same time will propel the user at a faster speed through the water than if only one of the motors 56 is activated at a time.

The provision of variable speed selection via a slide or rotary actuator or a two position toggle switch actuator may provide enhanced use of the apparatus 10 by providing the user with greater control over the speed of movement through the water.

The elongated tubular member 12 many also be employed in other configurations as long as the user can easily reach the pushbuttons 92.

Figure 6:
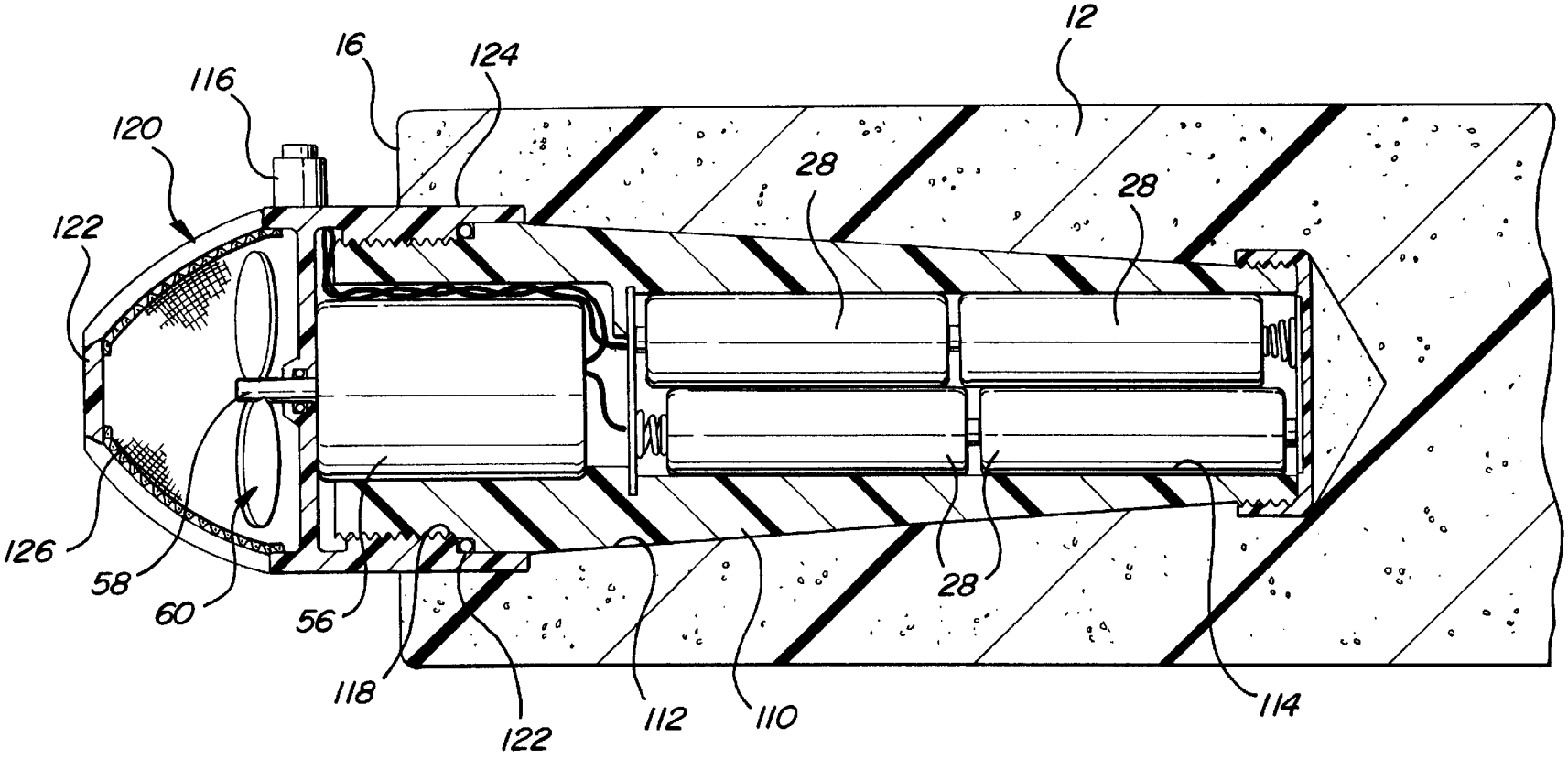
FIG. 6 is a longitudinal cross-sectional view depicting another embodiment of the motorized tubular flotation apparatus of the present invention.

Referring now to FIG. 6, there is depicted an alternate embodiment of the present apparatus in which the propulsion apparatus is mounted in a different manner to the tubular member 12.

In this embodiment, a housing 110 has a generally elongated form and is slidably inserted into the first end 16 of the tubular member 12 forming a bore 112 extending axially or longitudinally inward from the first end 16 in the tubular member 12. The bore 112 may be preformed as shown in FIG. 6 or formed by a forced insertion of the housing 110 into the end of the tubular member 12.

The housing 110 includes an internal compartment 114 for receiving one or more batteries 28. Batteries 28 are connected via wires and suitable connectors to an actuator push button 116 mounted externally of the housing 110 and the first end 16 of the tubular member 12 as well as to a propulsion means preferably utilizing the electric motor 56 having a rotatable output shaft 58 with a propeller 60 mounted thereon. A plurality of threads 118 are formed exteriorally on one end of the housing 110 and engage complimentary threads formed on an inner surface of a guard 120. An O-ring seal 122 is interposed in an annular groove in the housing 110 adjacent the threads 118 to singly couple the guard 122 to the housing 110.

The guard 120 includes one or more rib members 122 which extend from an annular collar 124 containing the internal threads. A plurality of intersecting screen or mesh members 126 are integrally formed in and extend between the rib or ribs 122 to prevent user contact with the rotating propeller 60 while still enabling an adequate supply of water through the guard 120 for outward propulsion force by the propeller 60.

The housing 110 may be press fit into the bore 112 in the tubular member 12 and/or secured in place in the bore 112 by means of a suitable adhesive. Once the housing 110 is mounted in the first end 16 of the tubular member 12, the actuator switch 116 may be utilized by the user, as described above, to selectively supply electric power to the motor 56 thereby rotating the propeller 60 to forcibly propel the user across the water surface.

Although the motorized tubular flotation apparatus 10 has been described in both embodiments as utilizing batteries and an electric motor to rotate a propeller, other propulsion means, such as an impeller which generates propulsion force by means of a forced flow of fluid through a small orifice or opening may also be employed. Such an impeller will also typically employ an electric motor which drives a propeller to forcibly urge water through the small orifice to create a high velocity water flow through an outlet to provide the necessary propulsion force.

In addition to the embodiments described above which disclose two means for mounting the propulsion means 14 to one end of the tubular flotation member 12, it will be understood that the propulsion means 14 may be strapped or tied by means of suitable tape or other straps or mounting members to one or both ends of the tubular flotation member 12 in a side-by-side arrangement with the flotation member 12 to provide the desired motorized propulsion described above.

In summary, there has been disclosed the unique motorized tubular flotation apparatus which provides propulsion force to a tubular flotation member thereby increasing the use enjoyment of the tubular flotation member. The propulsion means of the present invention are easily mounted to an existing tubular member in different configurations without any or substantial modification to the tubular flotation member. The propulsion means also provides selective user activation to enable the user to move him or herself through the water in a variety of directional paths and/or at different speeds.

What is claimed is:

1. A flotation apparatus comprising:

an elongated, flexible tubular member having first and second free ends, with at least one of the first and second ends adapted to be directionally moveable by direct user contact with the tubular member; and propulsion means, mountable to at least one of the first and second ends of the elongated tubular member, for propelling the tubular member and the user through the water.

2. The flotation apparatus of claim 1 further comprising:

propulsion means mountable on each of the first and second ends of the elongated tubular member.

3. The flotation apparatus of claim 1 further comprising:

means for mounting the propulsion means on at least one of the first and second ends of the tubular member.

4. The flotation apparatus of claim 3 wherein the propulsion means comprises:

a housing;

an electric motor mounted in the housing and having a rotatable output shaft;

a power source mounted in the housing for driving the motor; and a propeller connected to and rotated by the output shaft of the motor.

5. The flotation apparatus of claim 4 wherein the mounting means comprises:

a bore formed in one end of the housing;

one of the first and second ends of the tubular member fixedly mounted in the bore.

6. The flotation apparatus of claim 5 further comprising:

means for retaining the tubular member in the bore in the house.

7. The flotation apparatus of claim 6 wherein the retaining means comprises:

at least one finger extending angularly inward from the housing into the bore for engagement with the tubular member.

8. The flotation apparatus of claim 4 wherein the mounting means comprises:

the housing fixedly mounted in one of the first and second ends of the tubular member.

9. The flotation apparatus of claim 4 further comprising:

guard means, disposed about the propeller, for enclosing the propeller; and for allowing water flow through the guard means to the propeller.

10. The flotation apparatus of claim 4 wherein the power source comprises at least one electrical storage battery mounted in the housing.

11. The flotation apparatus of claim 4 wherein the propulsion means further comprises:

user actuated switch means, mounted on the housing, for connecting electric power from the power source to the motor.

12. The flotation apparatus of claim 1 wherein:

the tubular member is a buoyant member.

13. A propulsion apparatus for use with an elongated, flexible tubular member having first and second ends, the propulsion apparatus comprising:

a housing having a bore in one end receiving one of the first and second ends of the tubular member the propulsion means including:

an electric motor mounted in the housing and having a rotatable output shaft;

a power source mounted in the housing for driving the motor; and a propeller connected to and rotated by the output shaft of the motor.

14. The propulsion apparatus of claim 13 further comprising:

means for retaining the tubular member in the bore in the house.

15. The propulsion apparatus of claim 14 wherein the retaining means comprises:

at least one finger extending angularly inward from the housing into the bore for engagement with the tubular member.

16. The propulsion apparatus of claim 13 further comprising:

guard means, disposed about the propeller, for enclosing the propeller and for allowing water flow through the guard means.

17. The propulsion apparatus for claim 13 wherein the power source comprises at least one electrical storage battery mounted in the housing.

18. The propulsion apparatus of claim 13 wherein the propulsion means further comprises:

user actuated switch means, mounted on the housing, for connecting electric power from the power source to the motor.

19. A propulsion apparatus for use with an elongated, flexible tubular member having first and second ends, the propulsion apparatus comprising:

a housing fixedly mounted in one of the first and second ends of the tubular member; and propulsion means, carried by the housing, for propelling the housing and the elongated tubular member, the propulsion meanings including:

a propulsion apparatus for use with an elongated, flexible tubular member having first and second ends, the propulsion apparatus comprising;

a housing having a bore in one end receiving one of the first and second ends of the tubular member; and propulsion means carried by the housing, for propelling the housing and the elongated tubular member.

20. The propulsion apparatus of claim 19 further comprising:

guard means, disposed about the propeller, for enclosing the propeller and for allowing water flow through the guard means.

21. The propulsion apparatus of claim 19 wherein the power source comprises at least one electrical storage battery mounted in the housing.

22. The propulsion apparatus of claim 19 wherein the propulsion means further comprises:

user actuated switch means, mounted on the housing, for connecting electric power from the power source to the motor.

* * * * *